United States Patent [19]

Durst et al.

[11] Patent Number: 4,600,055

[45] Date of Patent: Jul. 15, 1986

[54] TUBULAR WELL TOOL RECEIVING CONDUIT

[75] Inventors: Douglas G. Durst, Pearland; Arthur J. Morris, Magnolia, both of Tex.

[73] Assignee: Camco, Incorporated, Houston, Tex.

[21] Appl. No.: 747,582

[22] Filed: Jun. 24, 1985

[51] Int. Cl.[4] ..... E21B 23/06

[52] U.S. Cl. ..... 166/115; 166/118; 166/134; 166/242

[58] Field of Search ..... 166/115, 116, 118, 134, 166/208, 179, 180, 135, 138–140, 120, 191, 195, 292; 285/338, 346, 348; 277/6, 5, 102, 116.2, 116.4, 116.8, 116.6

[56] References Cited

U.S. PATENT DOCUMENTS

| | | | |
|---|---|---|---|
| 494,918 | 4/1893 | Evans | 285/346 |
| 2,139,983 | 12/1938 | Stone | 166/195 |
| 2,671,512 | 3/1954 | Ragan et al. | 166/134 |
| 2,681,112 | 6/1954 | Lee | 166/134 |
| 2,768,845 | 10/1956 | Samiran | 285/348 |
| 2,872,961 | 2/1959 | Mills et al. | 285/348 |
| 3,227,218 | 1/1966 | Fisher, Jr. et al. | 166/208 |
| 3,615,160 | 10/1971 | Feather | 285/348 |
| 4,460,042 | 7/1984 | Galle, Jr. | 166/217 |
| 4,469,172 | 9/1984 | Clark | 166/115 |

*Primary Examiner*—James A. Leppink
*Assistant Examiner*—Hoang C. Dang
*Attorney, Agent, or Firm*—Fulbright & Jaworski

[57] ABSTRACT

A tubular well tool receiving conduit for receiving a well tool having anchoring teeth in which a plurality of circular extending grooves on the inside on the conduit are provided for coacting with the anchoring teeth for supporting the well tool. Preferably the grooves match the tooth profile of the anchoring teeth and the grooves are concentric. For receiving a well packer, a second plurality of circularly extending grooves on the inside of the conduit coact with the expandible seal for providing multiple seal points with the packer seal. A no-go shoulder on the conduit positions the well tool in the conduit. In another embodiment, the circular grooves extend longitudinally a greater distance to engage the well tool anchoring means and seal and extend continuously along the inside diameter.

5 Claims, 4 Drawing Figures

TUBULAR WELL TOOL RECEIVING CONDUIT

BACKGROUND OF THE INVENTION

It is common to anchor various well tools such as hangers or well packers inside of a well casing by means of slips. The slips are actuated outwardly such as hydraulically or mechanically whereby the teeth on the slips bite into and engage the well conduit or casing to support the well tool from movement in one or both directions in the conduit. However, in some cases the teeth on the slips do not firmly embed themselves into the inside of the conduit. It is also difficult for the slips to engage and grip the interior surface of well conduit made of materials having hardened surfaces or constructed of high strength materials.

Therefore, the present invention is directed to providing a tubular well tool receiving conduit such as a special casing nipple or joint which includes means for positively anchoring the well tool to withstand high differential loading from either the top to bottom or from the bottom to top and for increased load-bearing strengths and/or pressure retention and having means for coacting with well tool seals to create a greater sealing area contact and creating multiple independent seal surfaces.

SUMMARY

The present invention is directed to a tubular well tool receiving conduit for receiving a well tool having anchoring teeth in which the receiving conduit includes a plurality of circularly extending grooves on the inside of the conduit for coacting with the anchoring teeth for supporting the well tool in the conduit. It is desirable that the grooves match the tooth profile of the anchoring teeth for providing greater holding power. It is also preferable that the grooves are concentric.

A further object of the present invention is wherein a no-go shoulder is positioned on the inside of the conduit for positioning the well tool in the conduit in which the shoulder is positioned a predetermined distance from the grooves. Thus the anchoring teeth can be accurately aligned with the grooves.

Still a further object of the present invention is wherein the longitudinal width of the plurality of grooves is greater than the longitudinal width of the anchoring teeth for insuring that the teeth engage the grooves.

Still a further object of the present invention is a tubular well tool receiving nipple or joint for receiving a well packer having anchoring teeth and an expandible seal which includes a first plurality of circularly extending grooves on the inside of the conduit for coacting with the anchoring teeth for supporting the well tool from the conduit. A second plurality of circularly extending grooves are provided on the inside of the conduit and positioned for coacting with the expandible seal for providing multiple seal points with the seal. Preferably the grooves for coacting with the seal are concentric and noncommunicating with each other for creating independent seal surfaces at each groove. The grooves coacting with the anchoring teeth preferably have a matching tooth profile with the anchoring teeth.

Yet a further object of the present invention is wherein the circularly extending grooves extend continuously along the inside diameter of the conduit and extend a distance sufficient that a no-go shoulder is not required for the grooves to engage any anchoring teeth and/or seal on a well tool to be received.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENTS

Figure 1:
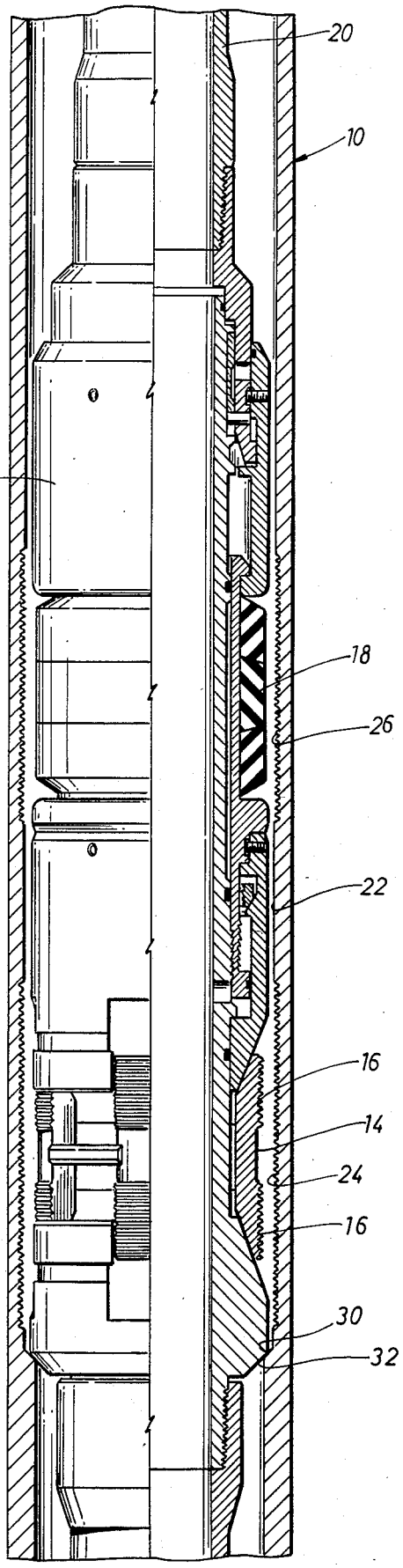
FIG. 1 is an elevational view in quarter section, of a well packer being installed in the special casing nipple of the present invention and shown in the retracted position.
Figure 2:
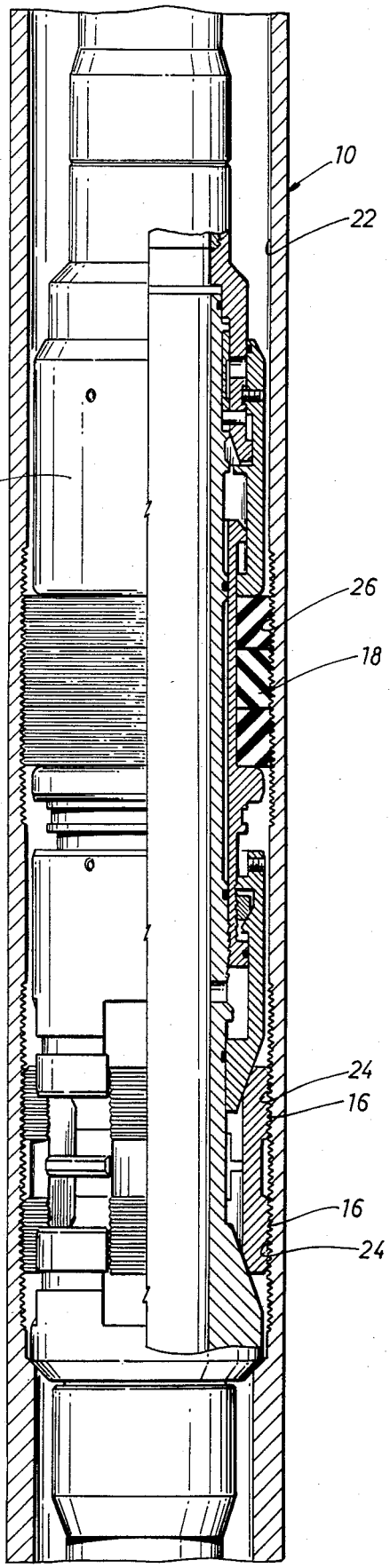
FIG. 2 is a view similar to FIG. 1 showing the well packer set, anchored, and sealed in the casing nipple.

Referring now to the drawings, and particularly FIGS. 1 and 2, the reference numeral 10 generally indicates the tubular well tool receiving conduit, such as a casing nipple or joint, which is provided for receiving a well tool having anchoring teeth such as a conventional well packer 12 which may be of any suitable type such as the type HRP sold by Camco, Incorporated. The conduit 10 includes threaded connections (not shown) in each end for connection in a well such as in a well casing. Well packers generally include one or more slip means 14 having anchoring teeth 16 and a packer seal means 18. The slip means 14 is adapted to be expanded outwardly as is conventional so that the teeth 16 may engage the interior wall of a casing for supporting the packer 12 therein. The seal means 18 are likewise expandible outwardly into engagement with the interior of a casing joint for providing a seal between the tubing string 20 and the inside of the casing.

In conventional casings, the interior diameter is smooth and the slip setting means 14 when expanded drives the teeth 16 outwardly into engagement with the interior surface 22 with a sufficient force to embed the teeth 16 into the inside of the casing. However, for various reasons the teeth 16 may not sufficiently penetrate the interior surface of the casing to adequately secure and anchor the packer 12 in the casing, particularly in the case of a high differential pressure loading across the packer from either the top to the bottom or the bottom to the top. Similarly, the packer seal 18 is expanded outwardly into engagement with a conventional casing. When the seal 18 is subjected to diffential pressures across the packer seal 18, particularly with changing pressures, the packer seal 18 may leak.

One feature of the present invention is the provision of a first plurality of circularly extending grooves 24 on the inside of the conduit or casing nipple 10 for coacting with the anchoring teeth 16 for supporting the well tool such as the packer 12 in the conduit 10. Preferably, the circularly extending grooves 24 are tooled grooves which match with the tooth profile of the anchoring teeth 16. The grooves 24 provide a means for positively anchoring the packer 12 or any other type of well tool in the casing nipple 10 to withstand high differential loading across the packer from either top to bottom or from bottom to top, and for increased load-bearing strengths and/or pressure retention. The tooled grooves 24 mesh with and coact with the tooth profile 16 of the slip means 14 or other tooth anchoring device to prevent longitudinal movement of the well tool or packer 12 relative to the conduit or casing 10.

In addition, a second plurality of circularly extending tooled grooves 26 are provided on the inside of the conduit 10 and positioned for coacting with the expandible seal 18 for providing multiple seal points with the seal 18. The tooled grooves 26 are preferably concentric circles so that they do not communicate with each other for providing a better seal. The tooled grooves 26 provide and create multiple seal points with the seal 18 relative to that which could be obtained on a smooth interior surface. The compression of the expandible seal 18 into the grooves 26 embeds the seal 18 within the grooves creating a greater surface area contact between the seal 18 and the interior surface 22 of the conduit 10 and more importantly creates independent seal surfaces at each of the grooves. Multiple seal points, coupled with the increased area of contact, will help to oppose fatigue and failure at higher pressures and temperature differentials to which the seal is exposed and will thus improve the performance of the standard packer 12.

In order to align the slip means 14 with the first plurality of grooves 24 and the expandible seal 18 with the second plurality of grooves 26, a no-go shoulder 30 may be provided in the casing nipple 10 for coacting with a shoulder 32 on the packer 12. The shoulder 30 is positioned relative to the grooves 24 and 26 to properly align the well packer with the grooves 24 and 26.

As has been previously mentioned, it is preferable that the grooves 24 and 26 be concentric noncommunicating tooled grooves, although if desired for easy manufacturing, a spiral or helical groove could be provided. And, of course, as is the case in some packers, if additional sets of slips 14 are used, additional pluralities of circularly extending grooves could be provided and positioned to engage the additional slip means. And in some cases, because of the type of sealing material used in the seal 18, or the type of setting action, it may be desirable to omit the second plurality of grooves 26 and allow the seal 18 to seal against a smooth or polished bore section of the conduit 10.

Figure 3:
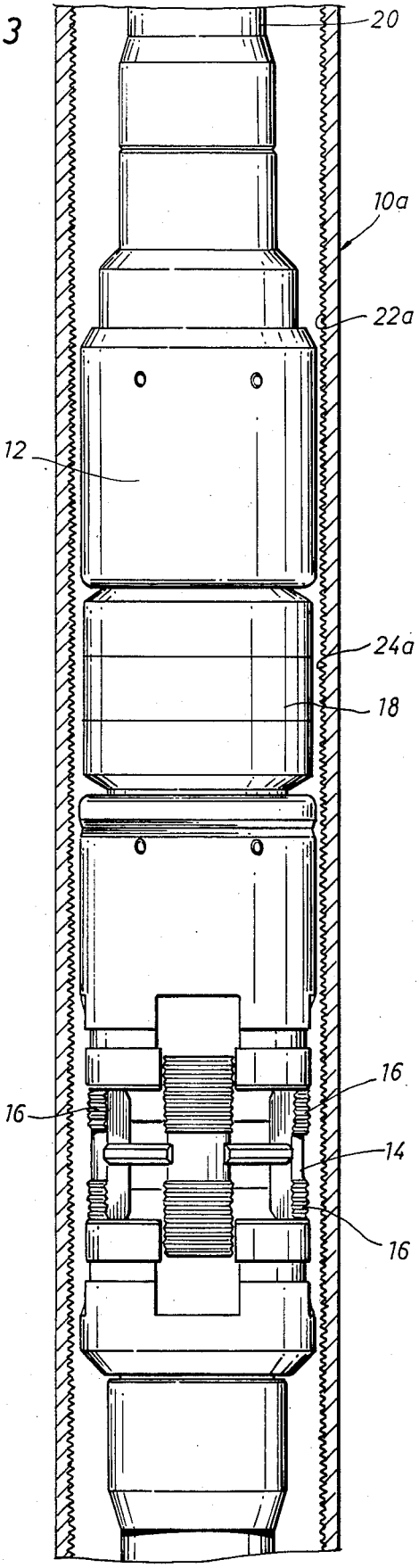
FIG. 3 is an elevational view, partly in cross section, illustrating a well packer being positioned in another embodiment of the casing nipple of the present invention and shown in the retracted position.
Figure 4:
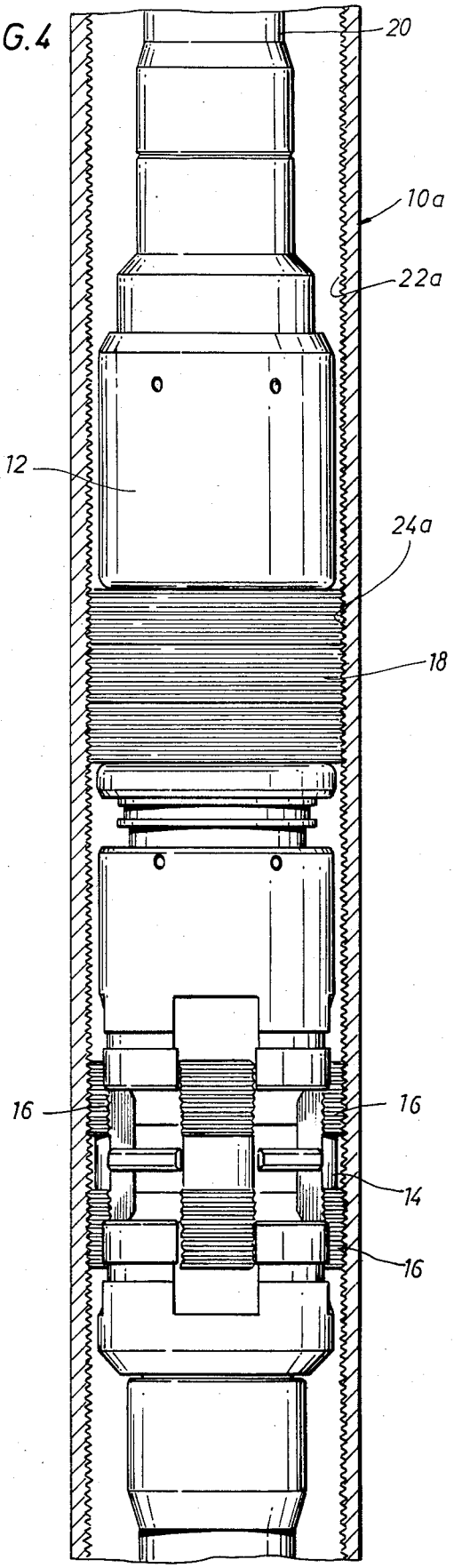
FIG. 4 is a view similar to FIG. 3 in which the well packer is set, anchored, and sealed in the nipple.

Other and further embodiments can be provided, as best seen in FIGS. 3 and 4, wherein like parts to those in FIGS. 1 and 2 are similarly numbered with the addition of the suffix "a". In FIGS. 3 and 4, the tubular well tool receiving conduit **10*a* or casing nipple has a first plurality of circularly extending grooves 24*a* continuously extending a sufficient length along the interior surface 22*a* of the conduit 10*a* to accommodate the length of the well tool such as the packer 12. The grooves 24*a* are continuous, therefore, the no-go shoulder may be omitted if desired as the longitudinal extent of the grooves 24*a* is sufficient so that the well tool 12 may be lowered within the nipple 10*a* with sufficient accuracy from a well surface for allowing the slip means 14 and expandible seal 18 to be positioned adjacent the grooves 24*a*. Again, it is preferable that the grooves 24*a* are concentric circular grooves that do not communicate with each other although, if desired, the grooves 24*a* may be a continuous spiral on the inside 22*a* of the conduit 10*a***.

In use, the well tool such as a hanger or well packer 12 is lowered into the conduit adjacent the tubular well tool receiving conduit to position the anchoring teeth 16 and/or expandible seal 18 adjacent the circularly extending grooves on the inside of the conduit 10 or **10*a*. The well tool is then conventionally actuated to expand the slips 14 and seal 18 into engagement with the circularly extending grooves for coacting with the grooves and positively locking the well tool 12 in position and providing a highly superior seal with the inside of the conduit 10 or 10*a***.

The present invention, therefore, is well adapted to carry out the objects and attain the ends and advantages mentioned as well as others inherent therein. While presently preferred embodiments of the invention have been given for the purpose of disclosure, numerous changes in the details of construction and arrangement of parts will be readily apparent to those skilled in the art and which are encompassed within the spirit of the invention and the scope of the appended claims.

What is claimed is:

1. In combination, a well packer and a tubular well tool receiving conduit comprising, a well packer having an expandable and retractable anchoring teeth and an expandable and retractable seal spaced from said anchoring teeth, a tubular well conduit including, a first plurality of circularly extending grooves on the inside of the conduit for coacting with the anchoring teeth for supporting the well tool in the conduit, a second plurality of circularly extending grooves on the inside of the conduit and positioned for coacting with the expandable seal for providing multiple seal points with the seal.

2. The apparatus of claim 1 wherein the second grooves for coacting with the seal are concentric and non-communicating with each other.

3. The apparatus of claim 2 including, a no-go shoulder positioned on the inside of the conduit for positioning the well tool in the conduit, said no-go shoulder positioned a predetermined distance from the grooves.

4. The apparatus of claim 3 wherein the first grooves match the tool profile of the anchoring teeth.

5. The apparatus of claim 1 wherein the circularly extending grooves extend continuously a longitudinal width greater than the total distance of the length of the seal, the length of the anchoring teeth, and the distance between the seal and the teeth.

* * * * *